US007052448B2

(12) United States Patent
Teeter

(10) Patent No.: US 7,052,448 B2
(45) Date of Patent: May 30, 2006

(54) TILTABLE EXERCISER HAVING MASSAGE DEVICE

(76) Inventor: Roger C. Teeter, 20720 Sang Island Dr., Sumner, WA (US) 98390

( * ) Notice: Subject to any disclaimer, the term of this patent is extended or adjusted under 35 U.S.C. 154(b) by 3 days.

(21) Appl. No.: 10/924,084

(22) Filed: Aug. 23, 2004

(65) Prior Publication Data

US 2006/0040812 A1 Feb. 23, 2006

(51) Int. Cl.
*A63B 26/00* (2006.01)

(52) U.S. Cl. ..... 482/144; 482/145

(58) Field of Classification Search ..... 482/143–145; 601/49–53, 87–112; 5/60–62; 128/33–36, 128/73–74, 57
See application file for complete search history.

(56) References Cited

U.S. PATENT DOCUMENTS

| | | | | | |
|---|---|---|---|---|---|
| 1,703,104 | A * | 2/1929 | Hassler | 482/97 |
| 2,640,480 | A * | 6/1953 | Hill | 601/102 |
| 2,915,057 | A * | 12/1959 | Ammon | 601/58 |
| 3,358,679 | A * | 12/1967 | Borrelli | 601/61 |
| 3,685,511 | A * | 8/1972 | Alvarez | 601/115 |
| 3,752,154 | A * | 8/1973 | Clark | 601/51 |
| 3,876,200 | A * | 4/1975 | Bush et al. | 482/132 |
| 4,103,681 | A * | 8/1978 | Shanley | 606/244 |
| 4,356,577 | A * | 11/1982 | Taylor et al. | 5/608 |
| 4,372,552 | A * | 2/1983 | Carlmark | 482/143 |
| 4,546,764 | A * | 10/1985 | Gerber | 601/53 |
| 4,915,101 | A * | 4/1990 | Cuccia | 606/244 |
| 5,885,197 | A * | 3/1999 | Barton | 482/144 |
| 5,967,956 | A | 10/1999 | Teeter | 482/144 |
| 6,319,213 | B1 * | 11/2001 | Tomac | 601/53 |
| 2003/0225351 | A1 * | 12/2003 | Wu | 601/99 |
| 2004/0049136 | A1 * | 3/2004 | Lin | 601/86 |
| 2004/0158181 | A1 * | 8/2004 | Watanabe et al. | 601/99 |
| 2005/0090769 | A1 * | 4/2005 | Chen | 601/99 |

* cited by examiner

*Primary Examiner*—Lori Amerson
(74) *Attorney, Agent, or Firm*—Charles E. Baxley

(57) ABSTRACT

A tilting inversion exerciser includes a stand, a table rotatably attached to the stand to support a user, and a carrier slidably received in the table. The carrier includes a massage device for massaging the user. The table includes a bolt rotatably received in a chamber and threaded to the carrier, to move the carrier relative to the table. A motor may be coupled to the bolt, to rotate or drive the bolt to move the carrier relative to the table. One or more cranks are rotatably attached to the carrier and each has one or more wheels for engaging with and for massaging the user. The carrier includes a motor for actuating the wheels to massage the user via the crank.

5 Claims, 3 Drawing Sheets

TILTABLE EXERCISER HAVING MASSAGE DEVICE

BACKGROUND OF THE INVENTION

1. Field of the Invention

The present invention relates to a tiltable or a tilting inversion exerciser, and more particularly to a tilting inversion exerciser having a massage device for massaging back portions of users in addition to rotational exercises.

2. Description of the Prior Art

Various kinds of typical inversion suspension exercisers, rotational exercisers, tilting inversion exercisers etc. have been developed and comprise a table rotatably or pivotally attached to a support, and rotatable relative to the support for conducting various inversion or suspension exercises.

For example, U.S. Pat. No. 5,967,956 to Teeter discloses one of the typical inversion suspension exercisers, and also comprises a table rotatably or pivotally attached to a support with a hanger bar, for allowing the users to rotate the table relative to the support, and to do various inversion or suspension exercises.

However, the typical inversion suspension exercisers do not have massage device to massage back portions of users, such that the users may use the conventional tilting inversion exercisers to conduct only the rotational or inversion exercises.

The present invention has arisen to mitigate and/or obviate the afore-described disadvantages of the conventional tilting inversion exercisers.

SUMMARY OF THE INVENTION

The primary objective of the present invention is to provide a tilting inversion exerciser including a massage device for massaging back portions of users in addition to rotational exercises.

In accordance with one aspect of the invention, there is provided a tilting inversion exerciser comprising a stand, a table rotatably attached to the stand, to support a user, and a carrier slidably received in the table, and including means for massaging the user.

The table includes a chamber formed therein, the carrier is slidably received in the chamber of the table. The table includes a bolt rotatably received in the chamber thereof, and threaded to the carrier, to move the carrier relative to the table.

The table includes means for driving the bolt to move the carrier relative to the table. For example, the driving means includes a motor received in the chamber of the table, and means for coupling the motor to the bolt. The coupling means includes two pulleys attached to the bolt and the motor respectively, and a belt coupling the pulleys together.

The massaging means includes at least one crank rotatably attached to the carrier, and at least one wheel attached to the crank for engaging with and for massaging the user. The carrier includes a motor received in the carrier, and coupled to the crank with a cam device, to actuate the wheel to engage with and to massage the user via the crank. The table includes a foot retaining device attached thereto, to retain feet of the user to the table.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
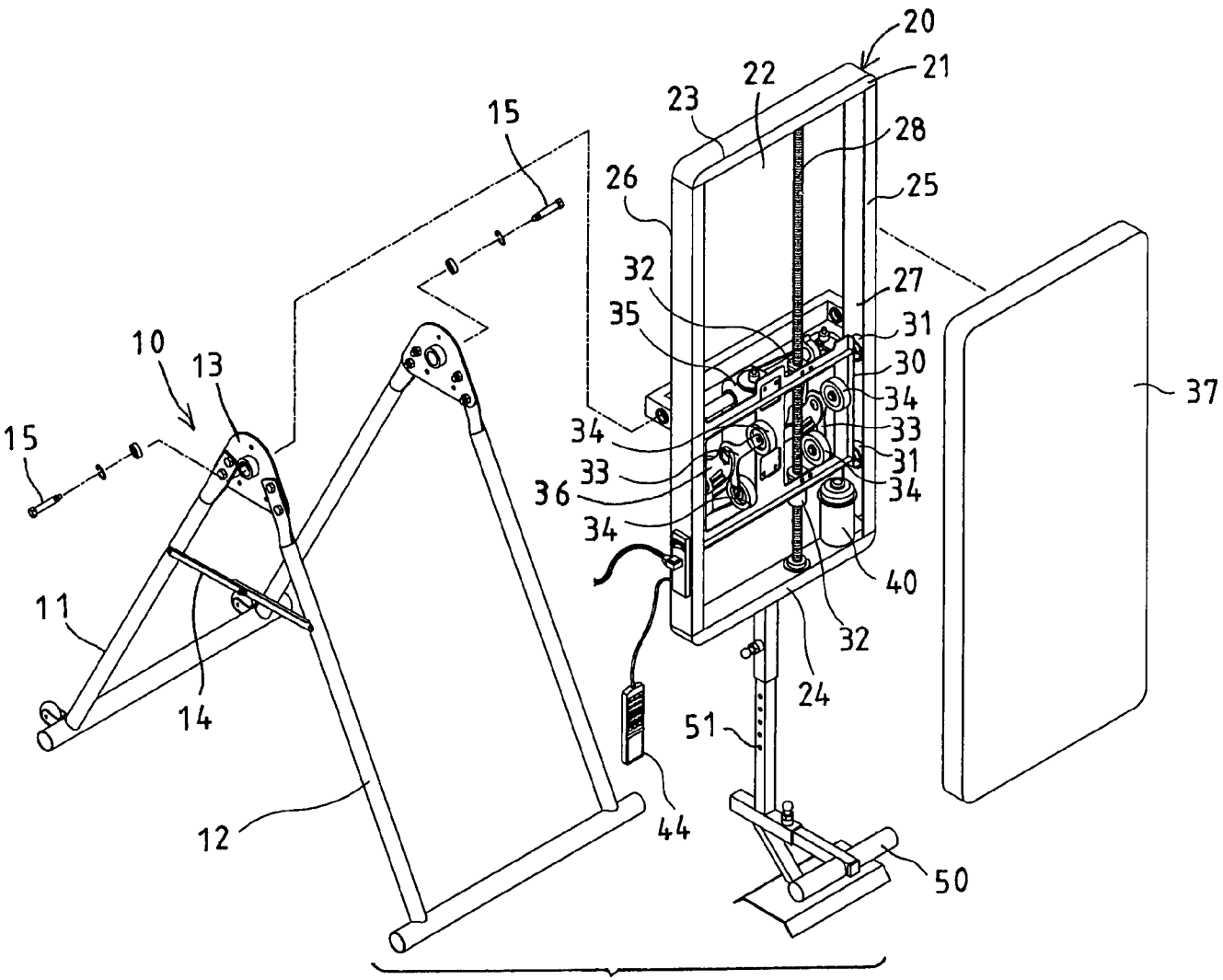
FIG. 1 is a partial exploded view of a tilting inversion exerciser in accordance with the present invention.
Figure 4:
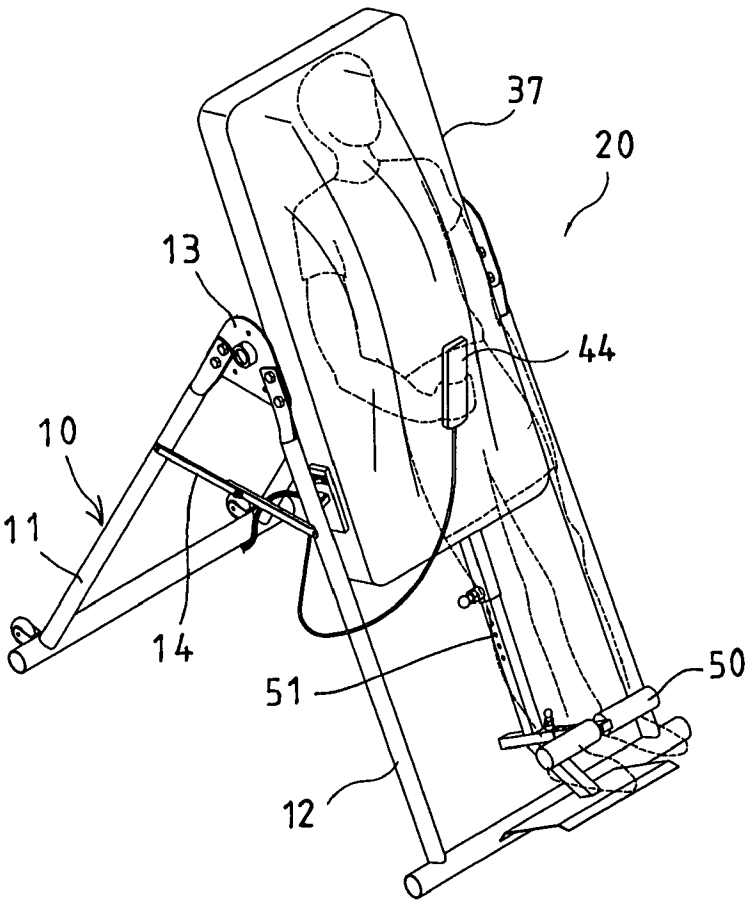
FIG. 4 is a perspective view similar to FIG. 2, illustrating the operation of the tilting inversion exerciser.
Figure 2:
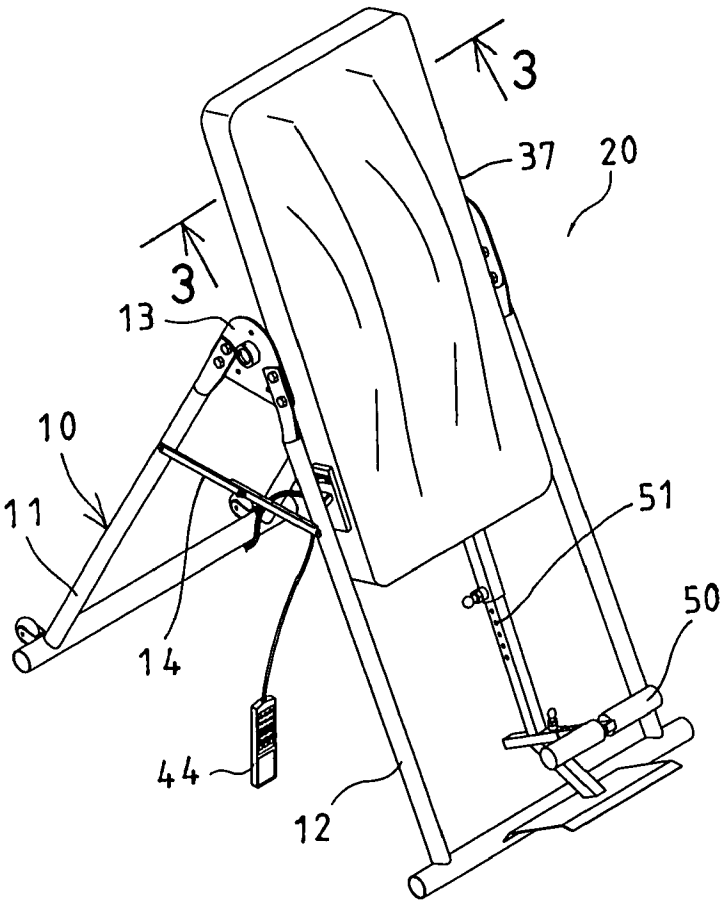
FIG. 2 is a perspective view of the tilting inversion exerciser.
Figure 3:
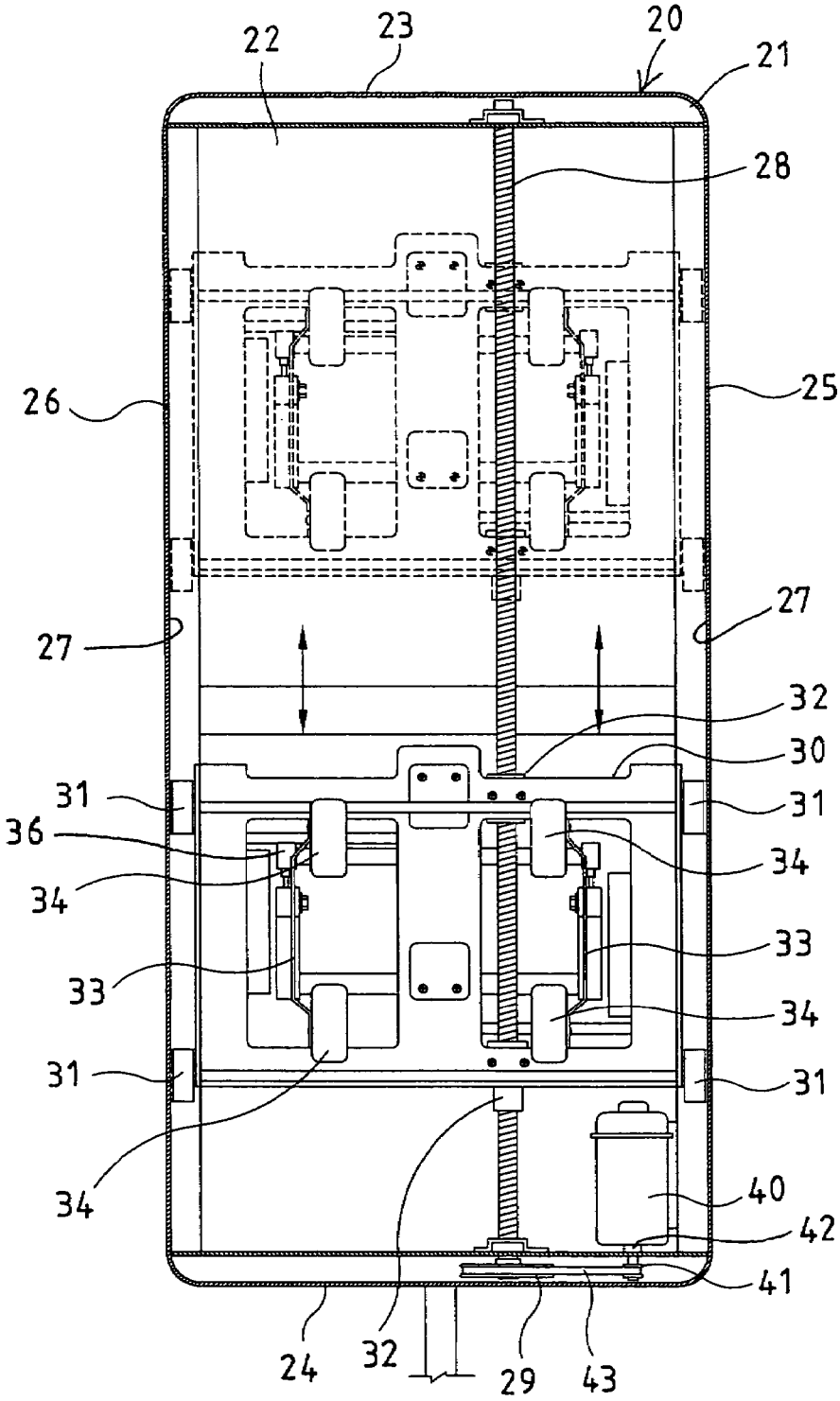
FIG. 3 is a partial plan view of the tilting inversion exerciser, in which an upper cushion has been removed to show an inner structure of the tilting inversion exerciser.

Referring to the drawings, and initially to FIGS. 1–3, a tilting inversion exerciser in accordance with the present invention comprises a stand 10 including two frames 11, 12 pivotally attached to an apex-connecting plate 13, and one or more foldable links 14 coupled between the frames 11, 12, to retain the frames 11, 12 of the stand 10 in an open or working position as shown in FIGS. 1, 2, 4. The links 14 are foldable for allowing the frames 11, 12, to be folded relative to the plate 13 to a folding or receiving position.

A table 20 is rotatably or pivotally attached to the stand 10 with one or more pivot shafts 15 or fasteners or the like, and includes a chamber 22 formed therein and defined by two end bars 23, 24 and two side beams 25, 26. Each of the side beams 25, 26 includes a channel 27 formed therein. A threaded rod or a bolt 28 is rotatably received in the chamber 22 of the table 20, and includes a sprocket or a gear or a pulley 29 (FIG. 3) attached to one end thereof.

A carrier 30 is slidably received in the chamber 22 of the table 20. For example, the carrier 30 includes one or more, such as four rollers 31 attached thereto, and slidably received in the channel 27 of the side beams 25, 26 of the table 20, to allow the carrier 30 to be smoothly slid or moved relative to the table 20. The carrier 30 includes one or more threaded barrels 32 attached thereto or provided therein, and threaded with the bolt 28, to allow the carrier 30 to be moved or guided along the chamber 22 of the table 20 by rotating the bolt 28 relative to the table 20.

A driving device 40, such as a motor 40 is also received in the chamber 22 of the table 20, and includes a sprocket or a gear or a pulley 41 (FIG. 3) attached to a spindle 42 thereof, and coupled to the pulley 29 of the bolt 28 with a chain or a gearing device or a belt 43, to allow the bolt 28 to be rotated or driven by the motor 40. It is preferable that the bolt 28 may be selectively rotated or driven by the motor 40 in either positive or opposite direction, to allow the carrier 30 to be moved either toward or away from the motor 40 by the bolt 28.

The carrier 30 includes one or more, such as two arms or cranks 33 rotatably or pivotally attached thereto, and each having one or more, such as two wheels 34 rotatably or pivotally attached thereto, such as attached to two ends thereof, for engaging with and for massaging users. Another driving device 40 or motor 40 may also be received in the carrier 30 and coupled to the cranks 33 with cam devices 36, for actuating or moving or rocking the cranks 33 and the wheels 34 relative to the carrier 30, in order to massage back portions of the users.

A soft or resilient cushion 37 may be attached onto the table 20, to cover the carrier 30 and the wheels 34. A foot retaining device 50 may further be provided and attached to the table 20 with an adjustable extension 51, for holding or retaining or positioning the feet of the users to the table 20.

A cable or remote control device 44 may be coupled and used to control or actuate the motors 35, 40, in order to operate the carrier 30 and the cranks 33. The control device 44 may also be used to control or actuate the motors 35, 40 remotely.

In operation, as shown in FIG. 4, the back portion of the user may be engaged onto or supported on the cushion 37, and the feet of the user may be retained or positioned in place by the foot retaining device 50. The carrier 30 may then be actuated to move along the bolt 28, and the cranks 33 may be actuated by the motor 35, to force the wheels 34 to engage with and to massage the back portions of the users, such that the users may conduct the typical rotational exercises or inversion or suspension exercises.

Accordingly, the tilting inversion exerciser in accordance with the present invention includes a massage device for massaging back portions of users in addition to rotational exercises.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tilting inversion massage exercise device comprising:

a stand rotatable at least 180 degrees, said stand including two frames pivotally attached to an apex-connecting plate, at least one foldable link coupled between said frames to retain said frames of said stand in an open or working position, a table rotatably attached to said stand, said table having one or more pivot shafts and being defined by two end bars and two side beams where each side beam has a channel; said table further including a chamber, a carrier including one or more threaded barrels, said carrier slidably received in said chamber of said table, said carrier further including means for massaging a user;

said means for massaging including at least one crank rotatably attached to said carrier and at least one wheel attached to said crank for engaging and massaging the user, said table having a threaded elongated bolt rotatably received in said chamber and threaded to said carrier to move said carrier relative to said table.

2. The tilting inversion exerciser as claimed in claim 1, wherein said table includes means for driving said bolt to move said carrier relative to said table.

3. A tilting inversion massage exercise device comprising:

a stand rotatable at least 180 degrees, said stand including two frames pivotally attached to an apex-connecting plate, at least one foldable link coupled between said frames to retain said frames of said stand in an open or working position, a table rotatably attached to said stand, said table having one or more pivot shafts and being defined by two end bars and two side beams where each side beam has a channel; said table further including a chamber, a carrier including one or more threaded barrels, said carrier slidably received in said chamber of said table, said carrier further including means for massaging a user; said means for massaging including at least one crank rotatably attached to said carrier and at least one wheel attached to said crank for engaging and massaging the user, said table having a elongated threaded bolt rotatably received in said chamber and threaded to said carrier to move said carrier relative to said table, and means for driving said bolt to move said carrier relative to said table, said driving means including a motor received in said chamber of said table, means for coupling said motor to said bolt, said means for coupling includes two pulleys and a spindle, where said pulleys are attached to said bolt and motor respectively at one end of said table, and a belt couples said pulleys together, and said table includes a foot-retaining device attached thereto, to retain feet of the user to said table.

4. The tilting inversion exerciser as claimed in claim 1, wherein said carrier includes a plurality of rollers and a motor received in said carrier, and coupled to said at least one crank with a cam device, to actuate said at least one wheel to engage with and to massage the user via said at least one crank.

5. The tilting inversion exerciser as claimed in claim 1, wherein said table includes a foot retaining device attached thereto, to retain feet of the user to said table.

* * * * *